US005791457A

United States Patent [19]

Castonguay et al.

[11] Patent Number: 5,791,457

[45] Date of Patent: Aug. 11, 1998

[54] MOTOR OPERATOR INTERFACE UNIT FOR HIGH AMPERE-RATED CIRCUIT BREAKERS

[75] Inventors: Roger N. Castonguay, Terryville; James L. Rosen, West Hartford, both of Conn.

[73] Assignee: General Electric Company, New York, N.Y.

[21] Appl. No.: 693,933

[22] Filed: Aug. 5, 1996

[51] Int. Cl.[6] ..... H01H 5/00

[52] U.S. Cl. ..... 200/400; 200/401

[58] Field of Search ..... 200/400, 401

[56] References Cited

U.S. PATENT DOCUMENTS

| | | | |
|---|---|---|---|
| 2,846,621 | 8/1958 | Coggeshall | 200/401 |
| 3,849,619 | 11/1974 | Patel | 200/401 |
| 4,001,742 | 1/1977 | Jencks et al. | 335/173 |
| 4,167,988 | 9/1979 | Acampora et al. | 200/400 |
| 4,672,501 | 6/1987 | Bilac et al. | 361/96 |
| 4,801,907 | 1/1989 | Kelaita , Jr. et al. | 335/20 |
| 5,424,701 | 6/1995 | Castonguay et al. | 335/172 |
| 5,486,667 | 1/1996 | Castonguay | 200/400 |
| 5,488,211 | 1/1996 | Castonguay | 200/400 |
| 5,489,755 | 2/1996 | Castonguay et al. | 200/400 |
| 5,495,082 | 2/1996 | Zaffeti et al. | 200/400 |

OTHER PUBLICATIONS

British Application #P87,407 M.A. Zaffetti, et als. Closing Arrangement for High Ampere-Rated Circuit Breakers Filed: Mar. 17, 1995 License No.; 506,162.

U.S. application Serial No. 08/315,385 M.A. Zaffetti, et al. Interlock for High Ampere-Rated Circuit Breakers Closing Springs Sept. 1994 Docket No. 41PR 7136.

U.S. application No. 08/220,382 R.N. Castonguay et al. A Motor Operator Interface Unit for High Ampere-Rated Circuit Breakers Filed: Mar. 30,1994 Docker No. 41PR-7121.

*Primary Examiner*—David J. Walczak

*Attorney, Agent, or Firm*—Richard A. Menelly; Carl B. Horton

[57] ABSTRACT

A high ampere-rated circuit breaker which meets the electrical code requirements of the world market. The charging of the powerful operating spring controlling the circuit breaker contacts is made automatically by means of an electric motor. The motor interlock arrangement prevents rotation of the closing shaft until and unless the circuit breaker contact closing spring has become completely charged.

18 Claims, 4 Drawing Sheets

MOTOR OPERATOR INTERFACE UNIT FOR HIGH AMPERE-RATED CIRCUIT BREAKERS

BACKGROUND OF THE INVENTION

U.S. Pat. No. 4,001,742 entitled "Circuit Breaker Having Improved Operating Mechanism" describes a circuit breaker capable of interrupting several thousand amperes of circuit current at several hundred volts potential. As described therein, the operating mechanism is in the form of a pair of powerful operating springs that are restrained from separating the circuit breaker contacts by means of a latching system. Once the operating mechanism has responded to separate the contacts, the operating springs must be recharged to supply sufficient motive force to the movable contact arms that carry the contacts.

U.S. Pat. No. 5,424,701 entitled "Operating Mechanism for High Ampere-Rated Circuit Breakers" describes an operating mechanism capable of immediately resetting the circuit breaker operating mechanism to reclose the contacts without having to recharge the circuit breaker operating springs immediately after opening the circuit breaker contacts.

U.S. Pat. No. 5,489,755, entitled "Handle Operator Assembly for High Ampere-Rated Circuit Breaker", describes a handle operator unit capable of generating large spring charging force by means of an externally-accessible manually-operated handle. A ratchet and pawl assembly allows the manually-applied charging forces to be applied to the operating springs. Once the circuit breaker operating mechanism closing springs are fully-charged, some means must be employed to release the pawl to allow the closing springs to become fully operational.

British Provisional Application No. P87,407, filed Mar. 17, 1995, describes an arrangement capable of releasing the fully charged closing springs.

U.S. Pat. application Ser. No. 08/315,385, filed Sep. 30, 1994, entitled "Interlock for High Ampere-Rated Circuit Breaker Closing Springs", describes a closing spring interlock arrangement, which provides a method to interlock the closing springs to insure that the closing springs are released only at the appropriate time.

U.S. Pat. application Ser. No. 08/220,382, filed Mar. 30, 1994, entitled "A Motor Operator Interface Unit for High Ampere-Rated Circuit Breakers", describes a simplified arrangement of an electric motor mechanism to automatically charge the circuit breaker closing springs.

One purpose of this invention is to provide a positive-acting, high tolerance take-up direct acting linkage system, working directly off the motor operator mechanism.

SUMMARY OF THE INVENTION

A circuit breaker operating mechanism is interlocked with the motor operator mechanism so that it is only possible for the closing springs to become operational to close the circuit breaker contacts after the motor operator mechanism has disengaged from the circuit breaker operating mechanism.

DESCRIPTION OF THE PREFERRED EMBODIMENT

Figure 1:
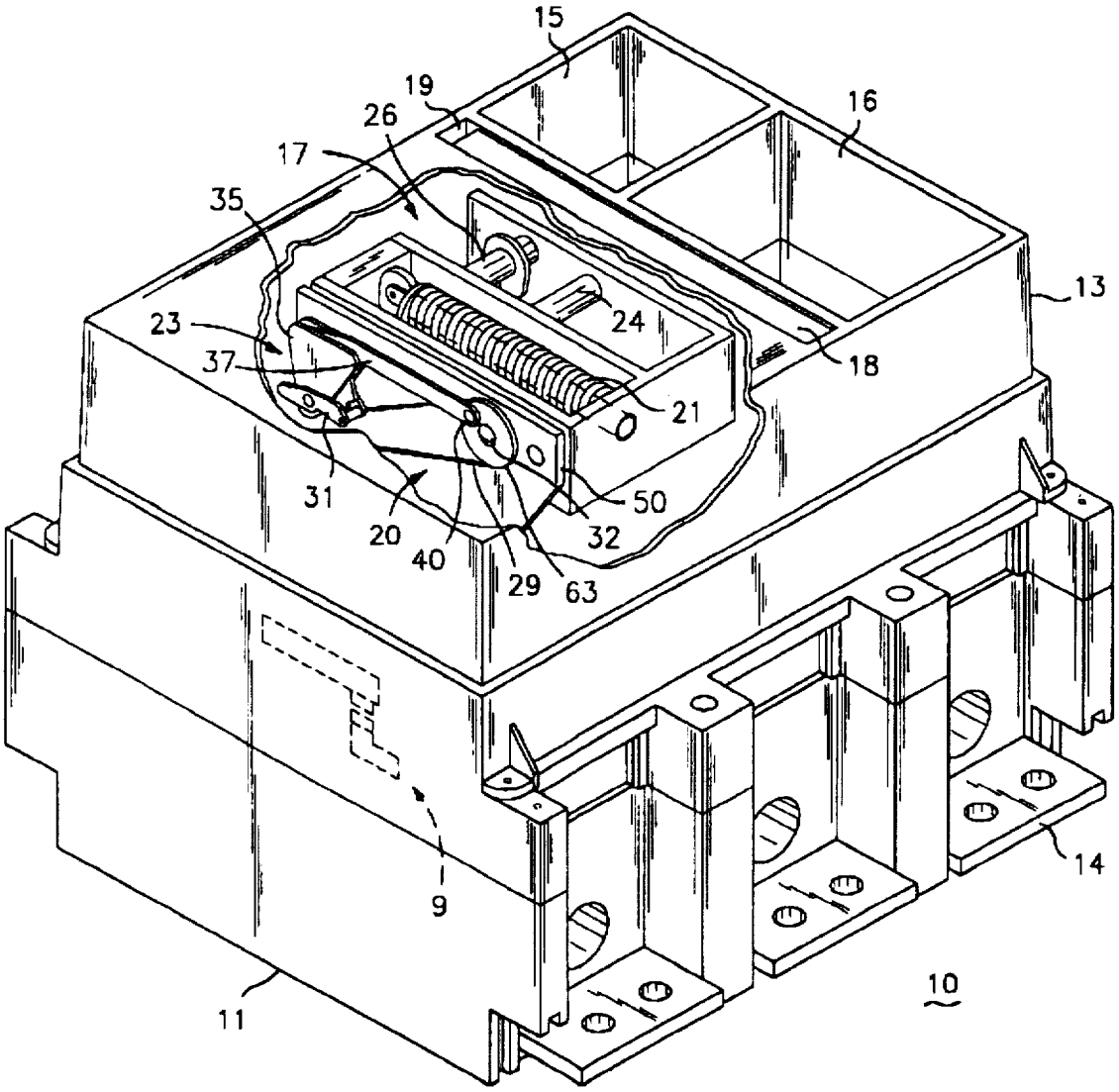
FIG. 1 is a top perspective view of a high ampere-rated circuit breaker with a portion of the circuit breaker removed to depict the motor operator interface unit according to the invention.

The motor interface unit 20 within the high ampere-rated circuit breaker 10 shown in FIG. 1 is capable of transferring several thousand amperes quiescent circuit current at several hundred volts potential without heating. The circuit breaker operating mechanism 17 is described within the aforementioned U.S. Pat. application Ser. No. 08/220,382, which is assigned to the assignee of the present invention. Electrical connection with the interior current-carrying components is made by load terminal straps 14 extending from one side of the base and line terminal straps (not shown) extending from the opposite side thereof. The interior components are controlled by an electronic trip unit contained within a recess 16 on the top surface of the top insulative cover 13. Although not shown herein, the trip unit is similar to that described within U.S. Pat. No. 4,672,501 entitled "Circuit Breaker and Protective Relay Unit", and interacts further with an accessory contained within the accessory recess 15 to provide a range of protection and control functions such as described, for example within U.S. Pat. No. 4,801,907 entitled "Undervoltage Release Accessory for a Circuit Breaker Interior". The operating mechanism 17 as described within U.S. Pat. No. 5,486,667 entitled "Rating Module Unit for High Ampere-Rated Circuit Breaker" includes the means required to charge the powerful closing spring 21 through the motor operator interface unit 20 and a clutch assembly 23. The closing spring, in turn, provides the motive force for closing the circuit breaker contacts, shown generally at 9 within the circuit breaker insulative case 11. The motor drive shaft 28 (FIG. 2) connects with the drive pulley 63 by means of the drive belt 29. The drive pulley also connects with the motor drive plate 35 and closing shaft link 31 by means of the drive link 37 which is assembled to the drive pulley by connecting pin 40. The drive pulley rotates on shaft 32. The motor drive and interface components are supported by means of the mounting plate 50 which locates the components relative to the operating mechanism drive shaft 24 and closing shaft 26. Manual forces to charge the closing springs are provided through operation of the operating handle 18 arranged within the handle recess 19.

Figure 2:
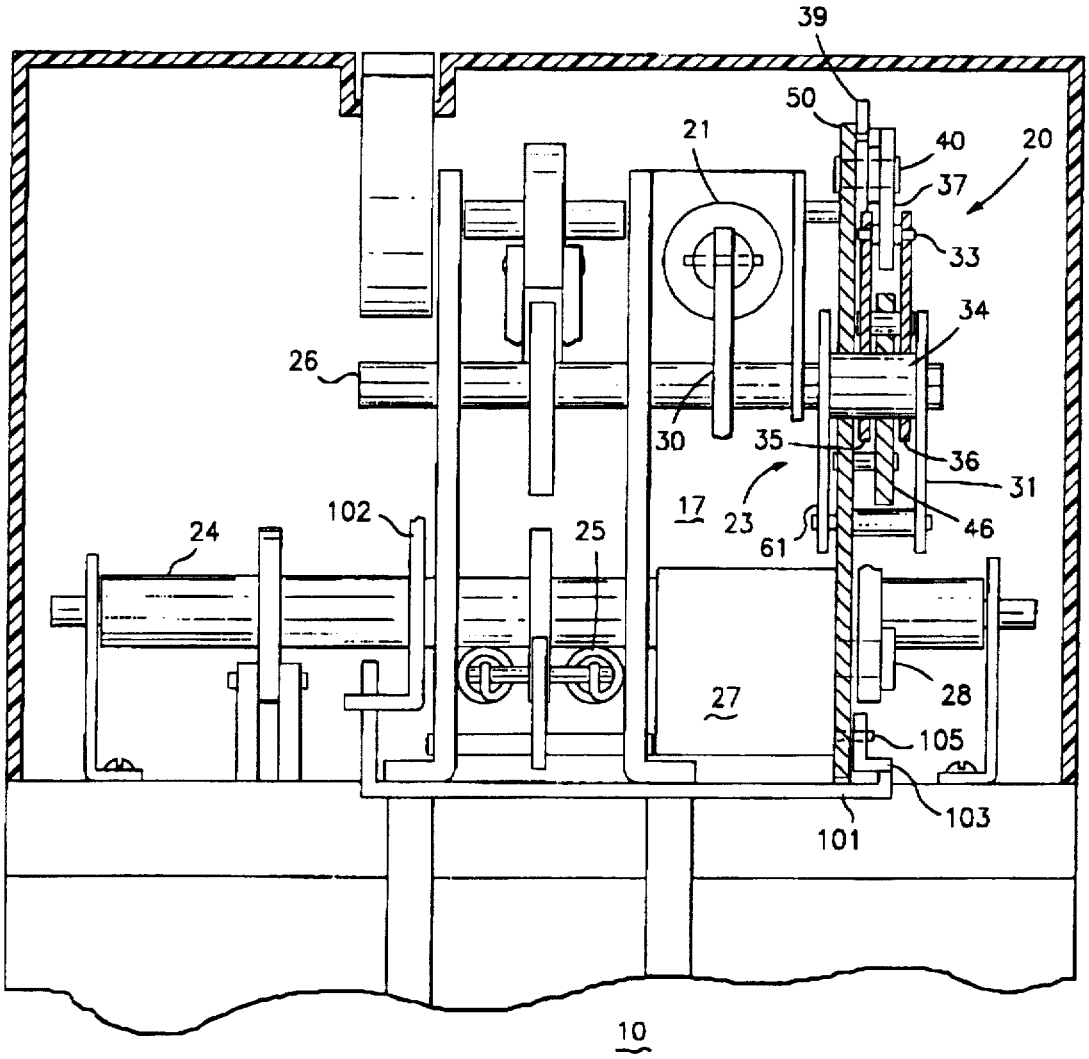
FIG. 2 is an enlarged end view in-partial section of the motor operator interface unit of FIG. 1.
Figure 3:
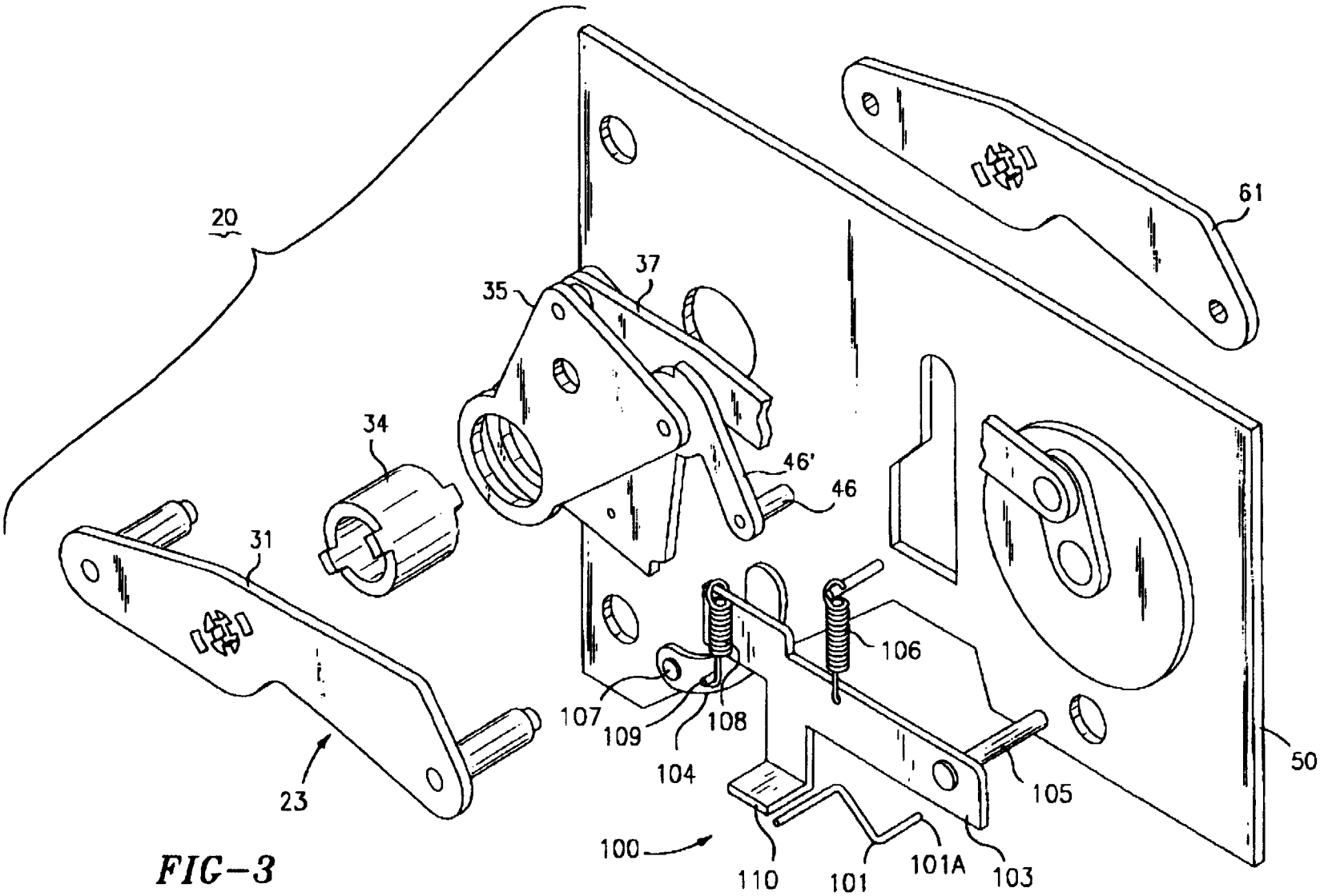
FIG. 3 is an enlarged top perspective of the motor operator interface unit within the circuit breaker of FIG. 1 with the components in isometric projection.
Figure 4:
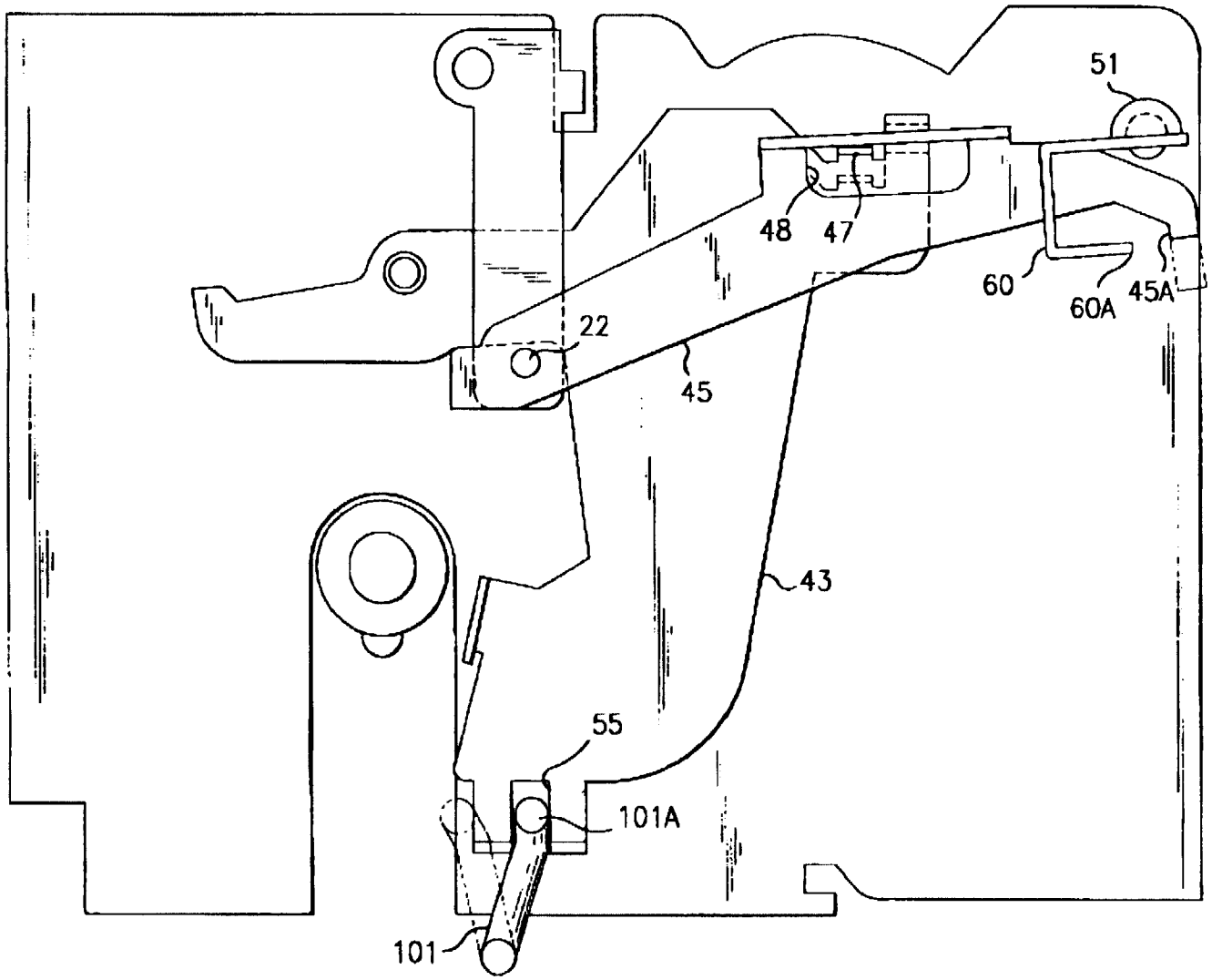
FIG. 4 is an enlarged plan side view of the closing spring release assembly and closing spring interlock arrangement within the circuit breaker of FIG. 1.

As shown in the circuit breaker 10 depicted in FIG. 2, the drive shaft 24 which operates to open the circuit breaker contacts is biased by means of a separate pair of operating springs 25 in the operating mechanism 17 as described within the aforementioned U.S. Pat. No. 4,001,742. The closing shaft 26 which connects with the closing spring 21 by means of the closing crank 30 also connects with the motor operator interface unit 20 by means of a pivot sleeve 34 and the drive pawl 46'. The connecting pin 40 attaches the drive pulley 39 and the drive link 37 to the support frame or mounting plate 50. The operator interface unit 20 includes closing shaft links 31, 61 which attach the unit to the closing shaft 26. The pivot sleeve 34 is accurately positioned within the clutch assembly unit 23 by capture between a pair of motor drive plates 35, 36 which are joined together by means of the clutch drive pin 33. In accordance with the teachings of the invention, the electric motor 27 interfaces with the circuit breaker operating mechanism via the clutch assembly unit 23 as shown in the aforementioned U.S. Pat.

application Ser. No. 08/220,382, the motor interface unit 20 and the motor interlock unit 100 (FIG. 3) to insure that the circuit breaker closing spring 21 does not become released to close the circuit breaker contacts unless and until the motor 27 has finished charging the closing springs. To this end an actuator lever 103, connected with the mounting plate 50 by means of a pivot pin 105, interacts with a connecting rod 101 and connecting lever 102 to control the release of the drive shaft 24 in the manner best seen by referring jointly to FIGS. 3 and 4.

The motor interface unit 20 is depicted with the clutch assembly 23 both unattached from and attached to the mounting plate 50 to detail the association between the closing shaft link 31, pivot sleeve 34, motor drive plate 35 and the drive link 37. When the closing shaft link 31 is attached to the mounting plate by means of the opposite closing shaft link 61, the drive pin 46 on the drive pawl 46' aligns with the actuator arm 104 to control the rotation of the end 101A of the connecting rod 101 within the slot 55 of the closing interlock link 43. The actuator lever 103 is attached to the mounting plate 50 by means of a pivot pin 105 with a return spring 106 positioning the actuator lever in its home position as viewed in FIG. 3. The actuator arm 104 is pivotally attached to the mounting plate 50 by means of a pin 107 and is connected with the actuator lever 103 by a take-up spring 108. Both the take-up spring 108 and the return spring 106 comprise extension springs. The take-up spring is riveted to the actuator lever 103 at one end and is removably connected with the actuator arm 104 at the other end by means of a pin 109. When the motor interface unit 20 is activated, pin 46 on the drive pawl 46' rotates in a clockwise direction, which engages the actuator arm 104 and rotates the actuator arm in the clockwise direction. The actuator arm, in turn, rotates the actuator lever 103 in the counter-clockwise direction by connection with the take-up spring 108. The rotation of the actuator lever 103 causes tab 110 on the actuator lever to contact the connecting rod 101, rotating the end 101A of the connecting rod 101 in the clockwise direction which prevents the release of the closing latch as described in aforementioned U.S. Pat. No. 5,495,082. The end 101A of the connecting rod 101 is captured within the slot 55 formed in the bottom of the closing interlock link 43. The rotation of primary latch 51 which releases the closing spring 21 (FIG. 2) is controlled by the relationship of drive link 45 and interlock link 43 as described in U.S. Pat. No. 5,488,211, entitled "A Latching Arrangement for High Ampere-rated Circuit Breaker Operating Springs". The drive link 45 pivots about the pin 22 and interacts with primary latch 51 which is attached to the bracket 60. The surfaces 45A and 60A respectively prevent release of the primary latch as indicated in solid lines and allow release thereof as indicated in phantom. The position of the drive link 45 is determined by the interaction of the tab 47 on the interlock link 43 and the slot 48 within the drive link 45. When the motor has completed the charging of the closing spring, the motor drive pawl 46' rotates in the counter-clockwise direction as viewed in FIG. 3 carrying the drive pin 46 away from the actuator arm 104 which allows the return spring 106 to rotate the actuator lever 103 clockwise and rotate the tab 110 on the actuator lever 103 thereby rotating the end 101A of the connecting rod to the phantom position. The counter-clockwise rotation of the end 101A of the connector rod 101, in turn, rotates the closing interlock link 43 in the counter-clockwise direction to allow the release of the primary latch 51 as described in U.S. Pat. No. 5,495,082 to allow rotation of the drive shaft 24 and release of the closing spring.

A motor operator interlock arrangement has herein been described as including a motor interlock unit that interacts with the circuit breaker motor interface assembly to prevent the circuit breaker operating mechanism from releasing the contact closing spring unless and until the associated electric motor has completed the contact closing spring charging operation.

We claim:

1. A circuit breaker closing spring motor interlock unit comprising:

a mounting plate;

a motor drive pulley arranged on said mounting plate and adapted for connection with an electric motor;

a drive link operatively connected with said drive pulley, said drive link including means for contacting an actuator arm connected to an actuator lever while said electric motor is in operation to charge a circuit breaker closing spring; and a connecting rod in abutment with said actuator lever at one end and positioned within a closing interlock link at an opposite end, said closing interlock link thereby prevented from rotation while said electric motor is in operation.

2. The circuit breaker closing spring motor interlock unit of claim 1 wherein said actuator lever is pivotally attached to said mounting plate at one end and attached to said actuator arm by means of a take-up spring at an opposite end.

3. The circuit breaker closing spring motor interlock unit of claim 2 wherein said actuator lever includes an actuator tab providing abutment with said connecting rod.

4. The circuit breaker closing spring motor interlock unit of claim 2 wherein said actuator lever is further connected to said mounting plate by means of a return spring.

5. The circuit breaker closing spring motor interlock unit of claim 4 wherein said take-up spring and said return spring comprise extension springs.

6. The circuit breaker closing spring motor interlock unit of claim 1 wherein said contacting means comprises a drive pin.

7. The circuit breaker closing spring motor interlock unit of claim 1 wherein said closing interlock link interacts with a circuit breaker latch assembly, said latch assembly being arranged for releasing a circuit breaker closing spring to close a pair of separable circuit breaker contacts.

8. The circuit breaker closing spring motor interlock unit of claim 7 wherein said latch assembly comprises a primary latch, said primary latche interacting with a latch bracket to control retention and release of said closing interlock link.

9. The circuit breaker closing spring motor interlock unit of claim 1 wherein said connecting rod rotates in a first direction to prevent release of said closing interlock link and rotates in an opposite direction to allow release of said closing interlock link.

10. An industrial-rated circuit breaker for high level overcurrent protection comprising:

an insulative base;

an insulative cover above said base, said cover enclosing a closing shaft and a drive shaft;

a closing spring connecting with said closing shaft, said closing spring receiving charging forces for moving said spring into a charged condition;

a latch assembly arranged for releasing said closing spring to close a pair of separable contacts within said base;

a motor operator interface unit interacting between said closing shaft and an electric motor, said motor becoming operational to provide said charging forces; and a motor interlock unit interacting with said interface unit and said latch assembly for preventing said closing spring from closing said contacts until said electric motor has completed operation;

a mounting plate;

a motor drive pulley arranged on said mounting plate and adapted for connection with said electric motor;

a drive link operatively connected with said drive pulley, said drive link including means for contacting an actuator arm connected to an actuator lever while said electric motor is in operation to charge said closing spring; and a connecting rod in abutment with said actuator lever at one end and positioned within a closing interlock link at an opposite end, said closing interlock link thereby prevented from rotation while said electric motor is in operation.

11. The industrial-rated circuit breaker of claim 10 wherein said actuator lever is pivotally attached to said mounting plate at one end and attached to said actuator arm by means of a take-up spring at an opposite end.

12. The industrial-rated circuit breaker of claim 11 wherein said actuator lever is further connected to said mounting plate by means of a return spring.

13. The industrial-rated circuit breaker of claim 12 wherein said contacting means comprises a drive pin.

14. The industrial-rated circuit breaker of claim 13 wherein said actuator lever includes an actuator tab providing abutment with said connecting rod.

15. The industrial-rated circuit breaker of claim 14 wherein said closing interlock link interacts with said latch assembly, said latch assembly being arranged for releasing said closing spring to close a pair of separable circuit breaker contacts.

16. The industrial-rated circuit breaker of claim 15 wherein said latch assembly comprises a primary latch, said primary latche interacting with a latch bracket to control retention and release of said closing interlock link.

17. The industrial-rated circuit breaker of claim 14 wherein said connecting rod rotates in a first direction to prevent release of said closing interlock link and rotates in an opposite direction to allow release of said closing interlock link.

18. The industrial-rated circuit breaker of claim 14 wherein said take-up spring and said return spring comprise extension springs.

* * * * *